United States Patent [19]

Inoue et al.

[11] Patent Number: 4,568,856

[45] **Date of Patent: * Feb. 4, 1986**

[54] HIGH PRESSURE METAL VAPOR DISCHARGE LAMP

[75] Inventors: Akihiro Inoue, Chigasaki; Tadao Kanoh, Fukisawa; Taketo Kamei; Akihiro Kamiya, both of Yokosuka; Toshihiko Ishigami, Yokohama; Akira Kohno, Yokohama; Hirok Sasaki, Yokohama, all of

[73] Assignee: Tokyo Shibaura Denki Kabushiki Kaisha, Kawasaki, Japan

[ * ] Notice: The portion of the term of this patent subsequent to Apr. 24, 2001 has been disclaimed.

[21] Appl. No.: 559,859

[22] Filed: Dec. 12, 1983

Related U.S. Application Data

[63] Continuation of Ser. No. 273,112, Jun. 12, 1981, abandoned.

[30] Foreign Application Priority Data

Jun. 18, 1980 [JP] Japan ..... 55-82418

[51] Int. Cl.[4] ..... H01J 7/44; H01J 65/08

[52] U.S. Cl. ..... 315/60; 315/73; 315/335; 313/54; 313/638; 313/639

[58] Field of Search ..... 315/60, 73, 335, 358; 313/54, 572, 638, 639; 252/517

[56] References Cited

U.S. PATENT DOCUMENTS

| | | | |
|---|---|---|---|
| 4,044,276 | 8/1977 | Keeffe et al. | 313/218 |
| 4,117,370 | 9/1978 | Jacobs et al. | 315/35 |
| 4,258,289 | 3/1981 | Michael | 315/73 X |
| 4,277,725 | 7/1981 | Sneijers | 315/73 |
| 4,445,067 | 4/1984 | Inoue et al. | 313/54 |

FOREIGN PATENT DOCUMENTS

| | | | |
|---|---|---|---|
| 1590980 | 5/1970 | France | 313/54 |
| 40-8514 | 2/1965 | Japan . | |
| 49-7271 | 3/1974 | Japan . | |
| 51-66174 | 9/1976 | Japan . | |
| 52-101876 | 8/1977 | Japan . | |

*Primary Examiner*—David K. Moore
*Assistant Examiner*—Vincent DeLuca
*Attorney, Agent, or Firm*—Oblon, Fisher, Spivak, McClelland & Maier

[57] ABSTRACT

A high pressure metal vapor discharge lamp including an arc tube having at least a main electrode at each end thereof, a fill sealed in the arc tube, including mercury, metal halide and starting gases selected from the group consisting of Ar, Kr and Xe, a radioactive source material, impregnated with a radioactive substance having a half-life less than $1 \times 10^4$ years, sealed in the arc tube and a circuit including a conventional low voltage mercury lamp ballast and a glow starter for starting the arc tube.

2 Claims, 5 Drawing Figures

HIGH PRESSURE METAL VAPOR DISCHARGE LAMP

This application is a continuation, of application Ser. No. 273,112, filed June 12, 1981, now abandoned.

BACKGROUND OF THE INVENTION

1. Field of the Invention

This invention relates generally to a high presure metal vapor lamp, and more particularly to such a lamp having an arc tube started by means of a glow starter and a radioactive substance provided in the arc tube.

2. Description of the Prior Art

High pressure metal vapor discharge lamps such as metal halide discharge lamps, have been used for their high luminous output and high luminous efficiency. Presently such lamps need their own specially designed ballasts because they have a high starting voltage compared to mercury lamps. Recently, a metal halide lamp which is started with a conventional and inexpensive mercury ballast has been developed. One method to start a lamp with a mercury lamp ballast reduces the starting voltage by using a neon (Ne) gas as a starting gas in the arc tube. That is, by using a well known Penning gas formed mainly of neon gas i.e. Ne (99%)—Ar (1%) or Ne (99%)—Kr (1%), it is possible to start such a lamp with a mercury lamp ballast because the starting voltage is reduced to about 150 V.

Although it is possible to reduce the starting voltage by using neon gas, some disadvantages are evident. Namely, the thermal conductivity of neon is larger than that of other gases such argon, krypton or xenon, so the luminous efficiency using mainly neon gas is reduced by five percent or more compared to using argon gas. Moreover, the use of neon gas results in early blackening of the arc tube and shortens the lamp life.

Accordingly, it is desirable not to use neon gas as a starting gas. So, another starting means using a glow starter has been considered. A lamp using a glow starter is known from Japanese Patent Disclosure No. 52-101,876 or U.S. Pat. No. 4,117,370. Such a lamp, by using a glow starter, easily produces high pulse voltages necessary for starting, while also being simple and inexpensive to manufacture.

However, a glow starter starting operation may be repeated again and again till the lamp actually begins to start. Such repetition of the starting operation shortens the life of a glow starter. But if there are no initial electrons provided as a seed to initiate discharge in the arc tube, it is extremely difficult to start the arc tube in spite of generating a high pulse voltage during glow starter starting operation. Namely the absence of initial seed electrons shortens the life of a glow starter.

On the other hand, it is known to use an emitter, such thorium oxide or thorium metal, as a starting seed. But thorium has a long half-life, i.e. $1.4\times10^{10}$ years, and it is therefore necesary to provide a large amount of thorium to assure electron release. Moreover, thorium reacts with other sealing metals, such as iodine, and this rapidly reduces the luminous efficiency.

SUMMARY OF THE INVENTION

Accordingly, one object of this invention is to provide a novel high pressure metal vapor discharge lamp started using a glow starter without using neon gas as a starting gas.

Another object of this invention is to provide a novel high pressure metal vapor discharge lamp started using a glow starter using a short half-life radioactive substance.

Yet another object of this invention is to provide a novel high pressure metal vapor discharge lamp started using a glow starter exibiting a high luminous efficiency.

A further object of this invention is to provide a novel inexpensive and highly reliable high pressure metal vapor discharge lamp started by means of a conventional low voltage mercury lamp ballast and a glow starter.

These and other objects have now been achieved according to this invention by providing a novel high pressure metal vapor discharge lamp having an arc tube started using a glow starter. Sealed in the arc tube are starting gases selected from the group of Ar, Kr and Xe and a radioactive substance having a half life less than $1\times10^4$ years.

BRIEF DESCRIPTION OF THE DRAWING

A more complete appreciation of this invention and may of the attendant advantages thereof will be readily obtained as the same becomes better understood by reference to be following detailed description when considered in connection with the accompanying drawings wherein.

DETAILED DESCRIPTION OF THE PREFERRED EMBODIMENT

Figure 1:
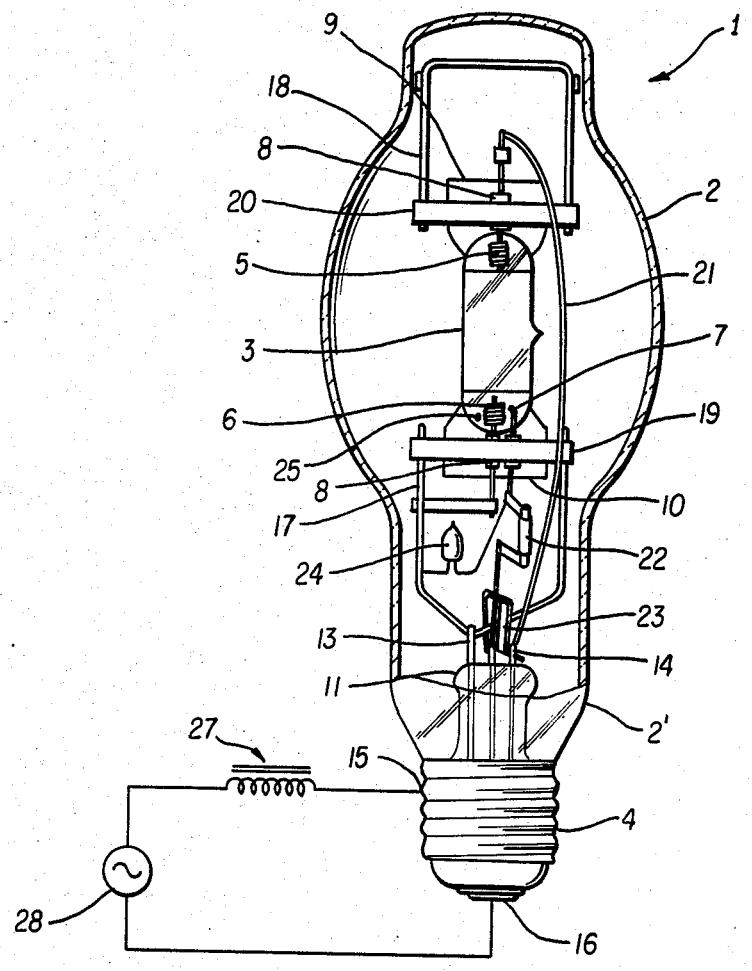
FIG. 1 is a longitudinal elevational view, partly in cross-section, of a high pressure metal vapor discharge lamp according to this invention.
Figure 2:
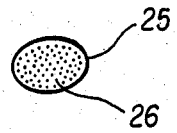
FIG. 2 is a schematic perspective view of a radioactive source material used according to this invention.

Referring now to the drawings wherein like reference numerals designate identical or corresponding parts through the several views, and more particularly to FIG. 1 and FIG. 2 thereof, there is shown a metal halide lamp 1 including a vitreous outer bulb 2 and a discharge tube, i.e. a quartz arc tube 3. The outer tube 2 has a screw base 4 at one end thereof. The arc tube 3 contains a quantity of mercury which is substantially completely vaporized and exerts a pressure from 1 to 10 atmospheres in operation, a quantity of scandium iodide and sodium iodide. An inert gas selected from the group consisting of Ar, Kr and Xe, for instance argon at a pressure of 100 torr, is included in the arc tube 3 to facilitate starting and warm-up. Main electrodes 5 and 6 are provided at each end of the arc tube 3 and a starting electrode 7 is provided near the main electrode 6. The electrodes 5 and 6 are supported on leads which include thin molybdenum foil sections 8 extending through respective pinch sealed ends 9 and 10 of the arc tube 3. Main electrodes 5 and 6 each include a tungsten wire around which a helix may be wrapped. The starter electrode 7 may be a fine tungsten wire having only a tip thereof projecting into the arc tube 3.

A neck part 2' of the outer tube 2 is sealed by a stem 11 through which extend stiff lead wires 13 and 14 which are respectively connected at their outer ends to the screw sheel 15 and to the outer contact 16 of the base 4.

The pinch sealed parts of the arc tube 3 are fixed to support structures 17 and 18 via metal holders 19 and 20. The support structure 17 is connected to the lead wire 13 by welding. The main electrode 6 is connected to the support structure 17 and the other main electrode 5 is connected to the lead wire 14 by way of a lead wire 21.

The starting electrode 7 is connected to a starting resistor 22 which is connected to the lead wire 14 by way of a bimetal switch 23 adapted to close at a normal temperature and to open above a predetermined temperature.

A glow starter 24 is connected to the starting electrode 7 and the support structure 17 by way of lead-in wires thereof.

Further, a radioactive source material 25 is sealed in the arc tube 3. The radioactive source material 25 consists of a ceramic material, i.e. aluminum oxide ($Al_2O_3$) and silicon oxide ($SiO_2$), impregnated with promethium (147 Pm) as a radioactive source 26 of about 0.1 micro curie (0.1 $\mu$Ci). The half-life of 147 Pm is 2.5 years. Namely, the radioactive source material is made as follows. Aluminum oxide ($Al_2O_3$), silicon oxide ($SiO_2$) and sodium oxide ($NA_2O_3$) are mixed at a predetermined ratio and burnt at about 2000° C. So the ceramic body is formed consisting of $xAl_2O_3.ySiO_2.zNA_2O_3$, where x, y, and z refer respectively to the molar ratio. Here, sodium (Na) atoms of the ceramic body are replaced with promethium (147 Pm) atoms by a well known method, i.e. an ion exchange method. Namely, the above ceramic body, $xAl_2O_3.ySiO_2.zNA_2O_3$, is to be changed to $xAl_2O_3.ySiO_2.z(NH_4)_2O$ by steeping in a liquid of ammonium chloride ($NH_4Cl$). Nextly, by a treatment of taking off ammonium ($NH_3$) from $xAl_2O_3.ySiO_2.z(NH_4)_2.O$, it is to be changed to $xAl_2O_3.ySiO_2.zH_2O$. Nextly, $xAl_2O.ySiO_2.zH_2O$ is induced to $xAl_2O_3.ySiO_2.zHPmO$ by replacing hydrogen (H) of $xAl_2O_3.ySiO_2.zH_2O$ with promethium ($^{147}$ Pm). Finally, by sintering at about 1200° C., a desirable radioactive source material 25 is produced. The safety of the radioactive source material 25 to the human body is proven by a well known test, i.e. a smear test.

Figure 3:
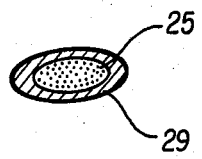
FIG. 3 is a schematic perspective view of another embodiment of a radioactive source material used according to this invention.

Moreover, the radioactive source material 25 can be made freely into a desired size, or shape as shown in FIGS. 2 and 3 and it is possible to seal the material 25 into the arc tube 3 through an exhaust tube with which the arc tube 3 is provided.

The above mentioned lamp 1 is connected to an electric power source 28 by way of a mercury lamp ballast 27.

In such a metal halide lamp, when voltage is impressed by way of the ballast 27, the glow starter 24 begins to operate because of current flowing through the bimetal switch 23 and the support structure 17. The operation of the glow starter 24 generates a pulse voltage. The pulse voltage initiates glow discharge between the main electrode 6 and the starting electrode 7, whereby the pulse voltage is superimposed on the secondary voltage of the ballast 27 and impressed across the main electrodes 5 and 6. The radioactive source material 25, at this time, is releasing electrons, so main arc discharge between the main electrodes 5 and 6 is easily initiated by the pulse voltage owing to the glow starter 24 operation. Once arc discharge occurs, the glow starter 24 no longer operates and generation of the pulse voltage ceases.

The glow starter 24, for example includes 10 torr argon gas, a 0.8 mm diameter and 2 mm length tungsten bar as a point of contact, and a 0.15 mm thick TNY bimetal. When such a glow starter 24 is used with a starting resister 22 having a 300Ω resistance, it generates a pulse voltage over ten times every second. Consequently, there are many advantages, such as quick operation, and inexpensive and simple construction derived by using a glow starter.

The half-life of a radioactive substance 26 used according to this invention is desirably less than $1\times10^4$ years, more particularly from 0.5 year to $1\times10^4$ years.

Such a lamp has in general 10,000 life hours, which corresponds to about six years life if the lamp is lighting for about five hours a day. If a radioactive substance 26 has a half-life 0.5 year, it will be $(\frac{1}{2})^{2\times6}=(\frac{1}{2})^{12}\cong2.4\times10^{-4}$ after six years. So, there remains a sufficient ability of releasing an electron to start discharge even after six years. But if the half-life is less than 0.5 year, the ability of releasing an electron is rapidly reduced and is not sufficient to last the life of the lamp.

On the other hand, if the half-life is too long, the starting characteristics are not good because the number of electrons released is small. So it is then necessary to have a large amount of a radioactive substance to improve the characteristics of the lamp. However, a large amount of a radioactive substance is a cause of decreased lumen output because of reaction with other sealed substances in the arc tube.

It is known that it is desirable to maintain the total atomic number of a radioactive substance to less than $10^{-3}$ times the total vaporized atomic number or the metal sealed in the arc tube. This number corresponds to about $10^{-6}$ g when converted to an amount sealed in the arc tube. When converting this number to a half-life, it corresponds to about $10^4$ years.

Such a suitable radioactive substance, for example, according to the invention is carbon (14C), sodium (22Na), calcium (45Ca), manganese (54Mm), iron (55Fe), cobalt (60Co), nickel (63Ni), zinc (65Zn), strontium (90Sr), lutetium (106Ru), silver (110Ag), antimony (125Sb), barium (133Ba), cesium (134Cs 137Cs), cerium (144Ce), prometium (147Pm), europium (154Eu, 155Eu), gold (195Au), tallium (204Te), lead (210Pb), radium (226Ra, 228Ra), actinium (227Ac), thorium (228Th), americium (241Am) and curium (242Cm, 244Cm).

EXAMPLE 1

50 toor argon gas as a starting gas, 30 mg dysporsium-thallium-sodium-cesium iodide, 0.1 g of a radioactive source material consisting of zeolite impregnated with 147 Pm, and mercury were sealed in an arc tube for a 400 W lamp. The arc tube and a glow starter including 100 torr argon gas were sealed in an outer bulb of a lamp. It was started with a mercury lamp ballast and the luminous efficiency was 88 lm/W. But it was 80 lm/W with a conventional lamp using neon (99%)—argon (1%) gases as a starting gas mixture and without using a glow starter and a radioactive source material.

EXAMPLE 2

50 torr kryton gas as a starting gas, 10 mg scandium-sodium iodide, a 0.05 g radioactive source material consisting of zealite impregnated with 65Ni, and mercury were sealed in an arc tube for a 100 W lamp. The arc tube and a glow starter including 50 torr neon (99%)—argon (1%) gases were sealed in an outer tube of a lamp. It was started with a mercury lamp ballast and the luminous efficiency was 75 lm/W. But it was 65 lm/W with a conventional lamp using neon (99%)—argon (1%) gases as a starting gas mixture, without using a glow starter and a radioactive source material.

EXAMPLE 3

25 torr argon gas as a starting gas, 60 mg scandium-sodium iodide, a 40 mg radioactive source material consisting of zeolite impregnated with 147Pm, and mercury were sealed in an arc tube for a 1 kW. lamp. The arc tube and a glow starter including 8 torr neon (50%)—argon (50%) mixture gases were sealed in an outer tube of a lamp. It was started with a mercury lamp ballast and the luminous efficiency was 115 lm/W. But it was 108 lm/W with a conventional lamp using neon (99%)—argon (1%) gases as a starting gas mixture and without using a glow starter and a radioactive source material.

EXAMPLE 4

50 torr argon gas as a starting gas, 30 mg scandium-sodium iodide, a radioactive source material consisting of zeolite impregnated with 147Pm, and mercury were sealed in an arc tube for 400 W lamp. The arc tube and a glow starter including 6 torr agron-helium gases were sealed in an outer tube of a lamp. It was started with a mercury lamp ballast and the luminous efficiency was 120 lm/W. But it was 95 lm/W with a conventional lamp using neon (99%)—argon (1%) gases as a starting gas mixture and without using a glow starter and a radioactive source material.

Various forms and structures of the radioactive source material are possible. It is possible to cover the radioactive source substance 25 with a substance 19 which includes metals sealed in the arc tube 3 or the same material consisting the electrode 5, 6 and 7.

Figure 4:
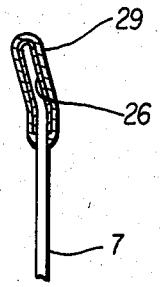
FIG. 4 is a logitudinal elevational view, partly in cross-section, of a starting electrode provided with a radioactive source.
Figure 5:
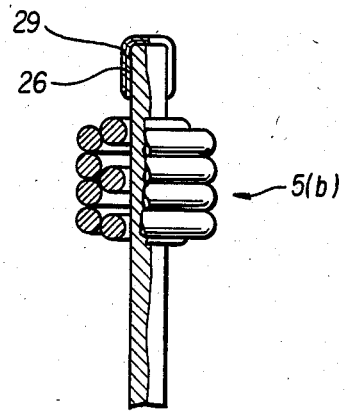
FIG. 5 is a logitudinal elevational view partly in cross-section, of a main electrode provided with a radioactive source.

Moreover, in FIG. 4, a radioactive source 26 is plated on the starting electrode 7 and then a sealed metal 29, i.e. scandium, is plated on the radioactive source 26. Moreover as shown in FIG. 5, it is possible to plate the radioactive source 26 on one or both of the main electrodes 5 and 6 instead of on the starting electrode 7. It is, of course, possible to provide the glow starter 24 outside the bulb 2.

In the lamp structure according to the invention, which is started using a glow starter, and a radioactive source material impregnated with a radioactive source which releases electrons, reliable lamp starting is achieved by means of the pulse voltage generated by operation of the glow starter.

Also, by not using neon gas as a starting gas, the luminous efficiency of the lamp of the invention is improved.

Obviously numerous modifications and variations of this invention are possible in light of the above teachings. It is thereof to be understood that within the scope of the appended claims, the invention may be practiced otherwise than as specifically described therein.

What is claimed as new and desired to be secured by Letters Patent of the United States is:

1. A high pressure metal vapor discharge lamp comprising:

an arc tube having at least a main electrode at each end thereof and a starting electrode mounted adjacent a selected of said main electrodes;

a fill, sealed in said arc tube, including mercury, sealed metals and a starting gas selected from the group consisting of Ar, Kr and Xe;

a radioactive source material, formed of a ceramic material impregnated with a radioactive substance having a half-life less than $1\times10^4$ years, sealed in said arc tube; and a circuit for starting said arc tube, comprising a glow starter connected across said starting electrode and said selected main electrode for generating a high voltage pulse to start a discharge in said arc tube and a mercury lamp ballast connected to said main electrodes;

wherein said radioactive source material is mounted on a selected of said main electrodes or said starting electrode.

2. The high pressure metal vapor discharge lamp of claim 1, wherein said radioactive substance is selected from the group consisting of 14C, 22Na, 45Ca, 54Mn, 55Fe, 60Co, 63Ni, 65Nz, 90Sr, 106Lu, 110Ag, 125Sb, 133Ba, 134Cs, 144Ce, 147Pm, 154Eu, 155Eu, 195Au, 204Tl, 210Pb, 226Ra, 228Ra, 227Ac, 228Th, 241Am, 242Cm and 224Cm.

* * * * *